US005640944A

United States Patent [19]

Minneman

[11] Patent Number: 5,640,944

[45] Date of Patent: Jun. 24, 1997

[54] METHOD AND APPARATUS FOR MAINTAINING A BOW

[76] Inventor: Steven W. Minneman, c/o MTM Molded Products Company, 3370 Obco Ct., Dayton, Ohio 45414

[21] Appl. No.: 557,333

[22] Filed: Nov. 14, 1995

[51] Int. Cl.[6] ..... F41B 15/00; B65D 85/00

[52] U.S. Cl. ..... 124/1; 124/23.1; 206/315.11; 206/317

[58] Field of Search ..... 124/1, 23.1, 86; 206/315.11, 317; 42/94; 89/37.04; 211/64, 13, 70.6

[56] References Cited

U.S. PATENT DOCUMENTS

| | | | |
|---|---|---|---|
| 2,740,530 | 4/1956 | Ponder | 211/64 |
| 2,877,689 | 3/1959 | Pribis | 89/37.04 |
| 3,055,655 | 4/1962 | Chelf | 124/86 X |
| 3,584,820 | 6/1971 | Butcher, Sr. | 42/94 X |
| 3,913,746 | 10/1975 | Burton | 211/64 |
| 3,931,833 | 1/1976 | Elkins et al. | 211/64 |
| 3,964,302 | 6/1976 | Gordon et al. | 73/117.3 |
| 3,964,613 | 6/1976 | Anderson, Jr. | 211/64 |
| 4,058,221 | 11/1977 | Elkins et al. | 211/87 |
| 4,232,919 | 11/1980 | Stewart | 312/254 |
| 4,531,643 | 7/1985 | Bradley | 211/64 |
| 4,666,038 | 5/1987 | Minneman | 206/315.2 |
| 4,807,381 | 2/1989 | Southard | 42/94 |
| 4,815,593 | 3/1989 | Brown | 206/315.11 |
| 4,823,673 | 4/1989 | Downing | 89/37.04 |
| 4,971,208 | 11/1990 | Reinfried, Jr. et al. | 211/64 |
| 4,998,944 | 3/1991 | Lund | 42/94 |
| 5,058,302 | 10/1991 | Minneman | 42/94 |
| 5,125,389 | 6/1992 | Paff | 124/86 |
| 5,346,063 | 9/1994 | Chow | 211/70.6 X |
| 5,370,240 | 12/1994 | Hand | 211/13 |
| 5,482,241 | 1/1996 | Oglesby | 211/60.1 X |

OTHER PUBLICATIONS

"Case–Gard: RMC–1 Portable Maintenance Center", by MTM Molded Products Company, 3370 Obco Court, Dayton, OH 45413, 1 pg. advertisement, (date unknown).

"RMC–1 Portable Rifle Maintenance Center, by Case–Gard", by MTM Case–Guard, PO Box 14117, Dayton, OH 45413, 1 pg. advertisement (1990).

"New Rifle Cleaning Rest", by Wilwood Products, Inc., PO Box 88865, Atlanta, Ga. 30338, 1 pg. advertisement, (date unknown).

*Rifle: The Magazine for Shooters,* vol. 10, No. 5, Sep.–Oct. 1978, pp. 4,54,59,62, & 66.

1990 MTM Case–Gard Catalog, by MTM Molded Products Company, 3370 Obco Court, PO Box 14117, Dayton, OH 95413, 14 pgs.

1992 MTM Case–Gard Catalog, by MTM Molded Products Company, 3370 Obco Court, PO Box 14117, Dayton, OH 45413, 14 pgs.

*Primary Examiner*—Randolph A. Reese
*Assistant Examiner*—Thomas A. Beach
*Attorney, Agent, or Firm*—Jacox, Meckstroth & Jenkins

[57] ABSTRACT

A method and apparatus for maintaining a bow comprises a maintenance base having a plurality of apertures for receiving tools and cleaning accessories for maintaining and servicing the bow. Also, a plurality of apertures are provided having varying depths for receiving at least one fork member having substantially similar apertures for receiving the bow in one of a plurality of angular maintenance positions so that an archer can support the bow above a surface without the use of his hands. The plurality of supports may also comprises a strap or latch for facilitating supporting the bow in a substantially upside down position relative to the base. An adjustable fork is also provided for adjusting the angular position of the bow-receiving apertures in the fork. This facilitates supporting the bow in one of the plurality of angular positions.

18 Claims, 7 Drawing Sheets

METHOD AND APPARATUS FOR MAINTAINING A BOW

BACKGROUND OF THE INVENTION

1. Field of the Invention

This invention relates to a method and apparatus for maintaining a bow, and more particularly, to a method and apparatus for maintaining a bow in a predetermined position.

2. Description of Related Art

U.S. Pat. No. 5,058,302 discloses a portable rifle maintenance center which includes a rectangular tray having a gun support fork attachable to the rectangular tray for temporarily supporting a rifle in a horizontal position.

U.S. Pat. No. 3,964,613 discloses a rifle support having vertical uprights for positioning the rifle, and further including an integral storage compartment for such items used with the rifle.

U.S. Pat. No. 4,815,593 shows a similar structure having vertical supports for retaining a long-barreled rifle in a horizontal position and further includes a storage compartment as shown in either of FIGS. 1 or 2 of the disclosure.

The problem with devices of the type shown in these patents is that they were not suitable for use in supporting a bow. Further, the devices shown were not designed to support a bow in one of a plurality of predetermined bow positions so that the bow could be, for example, cleaned, serviced or otherwise maintained.

SUMMARY OF THE INVENTION

It is, therefore, a primary object of this invention to provide a method and apparatus for maintaining a bow.

Another object of this invention is to provide a method and apparatus for supporting a bow by its stave and/or in one of a plurality of angular bow support positions to facilitate quickly and easily adjusting, maintaining and/or cleaning the bow.

Another object of this invention is to provide a method and apparatus for supporting a bow without the use of hands.

Another object of this invention is to provide a method and apparatus for supporting a bow, while the bow has a bow press secured thereto.

In one aspect of the invention, this invention comprises a bow maintenance center having a maintenance base for receiving at least one bow maintenance item and an adjustable support situated on the maintenance base for adjustably supporting the bow in a plurality of maintenance positions.

In another aspect of this invention, this invention comprises a method for servicing a bow consisting of the steps of adjustably positioning at least one adjustable support on a base; at least one adjustable support comprising a plurality of bow receiving areas for receiving the bow and for supporting the bow in a plurality of different angular positions, and situating the bow on the at least one adjustable support, thereby causing the bow to be positioned in one of the plurality of different angular positions.

In still another aspect this invention comprises a bow maintenance system consisting of a maintenance base, an angular support coupled to the maintenance base for receiving a bow and for supporting the bow in a maintenance position above the maintenance base.

These and other objects and advantages of the invention and others will be apparent from the following description, the accompanying drawings and the appended claims.

DETAILED DESCRIPTION OF THE INVENTION

Figure 1:
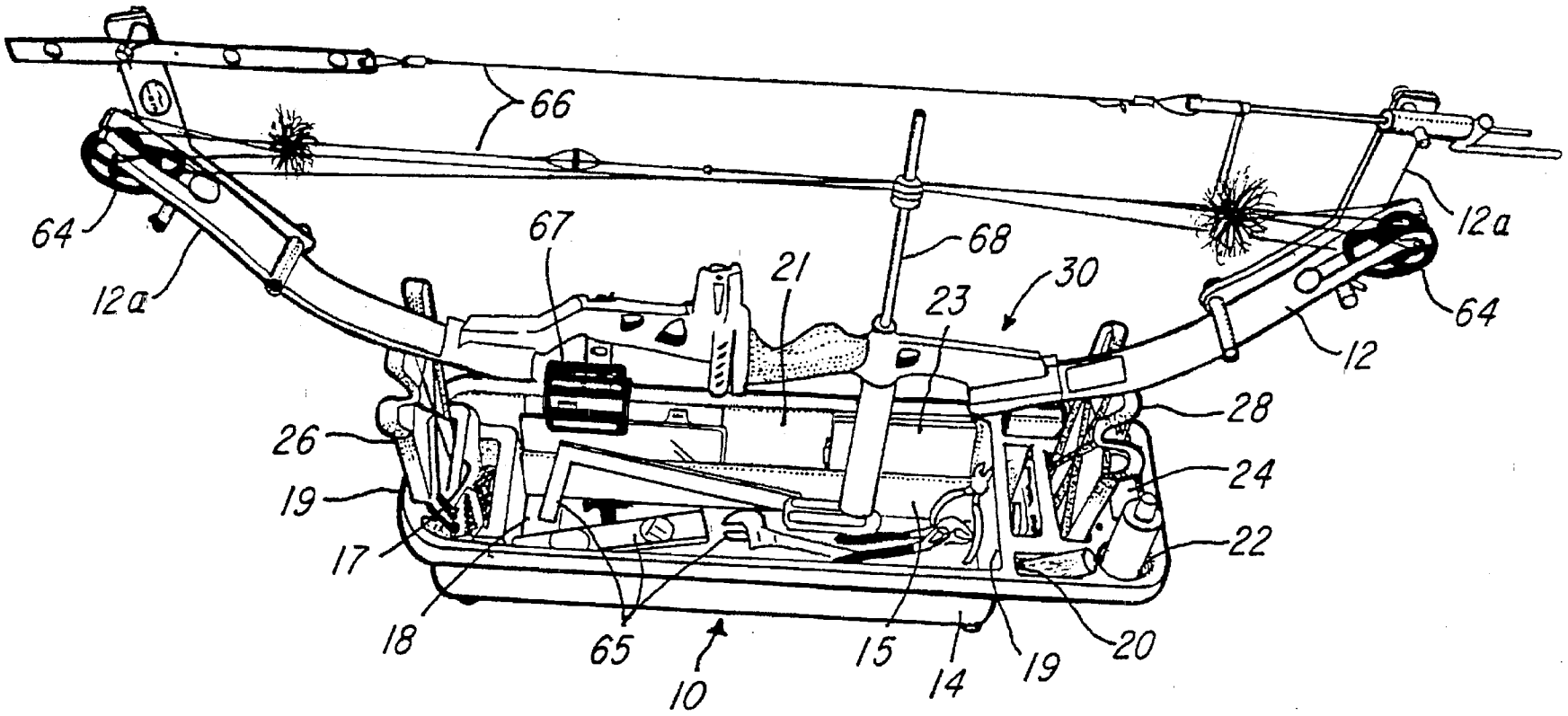
FIG. 1 is an elevational view of a bow maintenance center shown supporting a bow in an cable-up position.

Referring now to FIG. 1, a bow maintenance center 10 is shown supporting a bow 12 having a stave 13 and cables 66. The bow maintenance center 10 comprises a maintenance base 14 having a plurality of support apertures 16*a* (FIG. 3), 16*b*, 16*c* and 16*d*. The function of the support apertures 16*a*–16*d* will be described later herein. The base 14 also comprises a plurality of receiving storage compartments or apertures, such as compartments 18 (FIG. 1), 20, 22 and 24. The function of the compartments 18–24 is to receive and support items, such as tools, cleansers, and other maintenance items to facilitate cleaning and maintaining the bow 12.

Notice also that the base 14 (FIG. 3) may comprise a plurality of rubber feet 56 which facilitate preventing the base 14 from moving when the bow 12 is being serviced.

Figure 3:
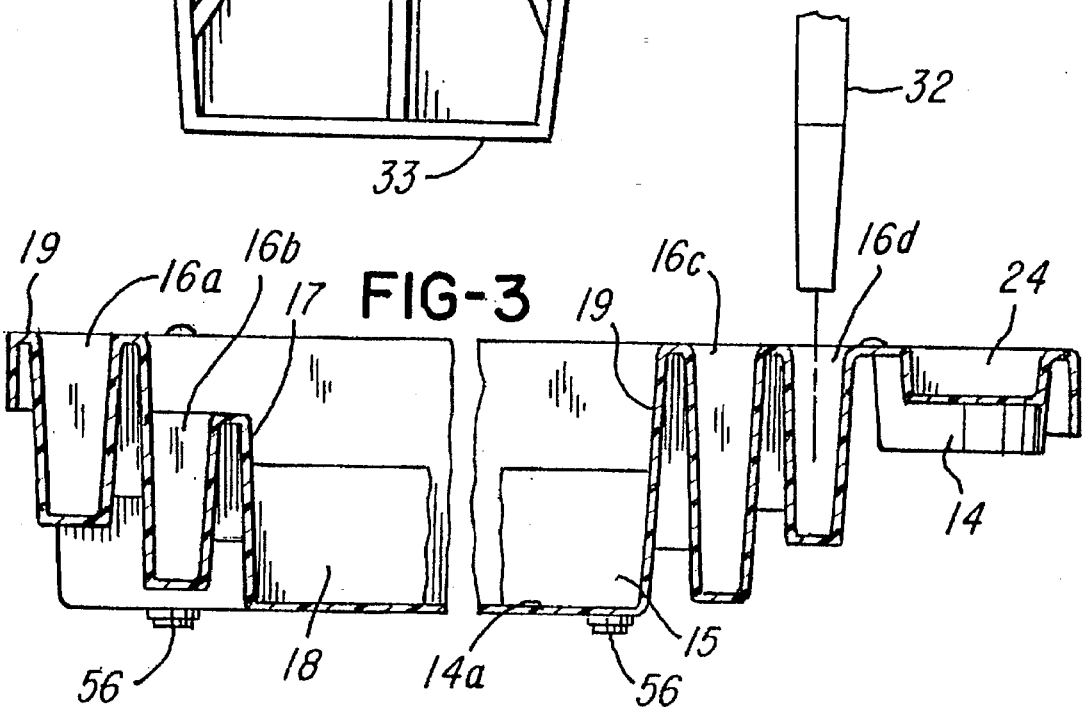
FIG. 3 is a fragmentary sectional view of the base of the bow maintenance center.

In the embodiment being described, the base 14 may have an upper cover (not shown) for storing the tools and accessories and supports 26 and 28 when the supports 26 and 28 are dismounted and placed in compartment 18. As best illustrated in FIG. 3, the apertures 16*a*–16*d* are slightly tapered, as well as a bottom of support 26 is inserted in one of the apertures 16*a*–16*d*, it becomes securely mounted therein.

Figure 2:
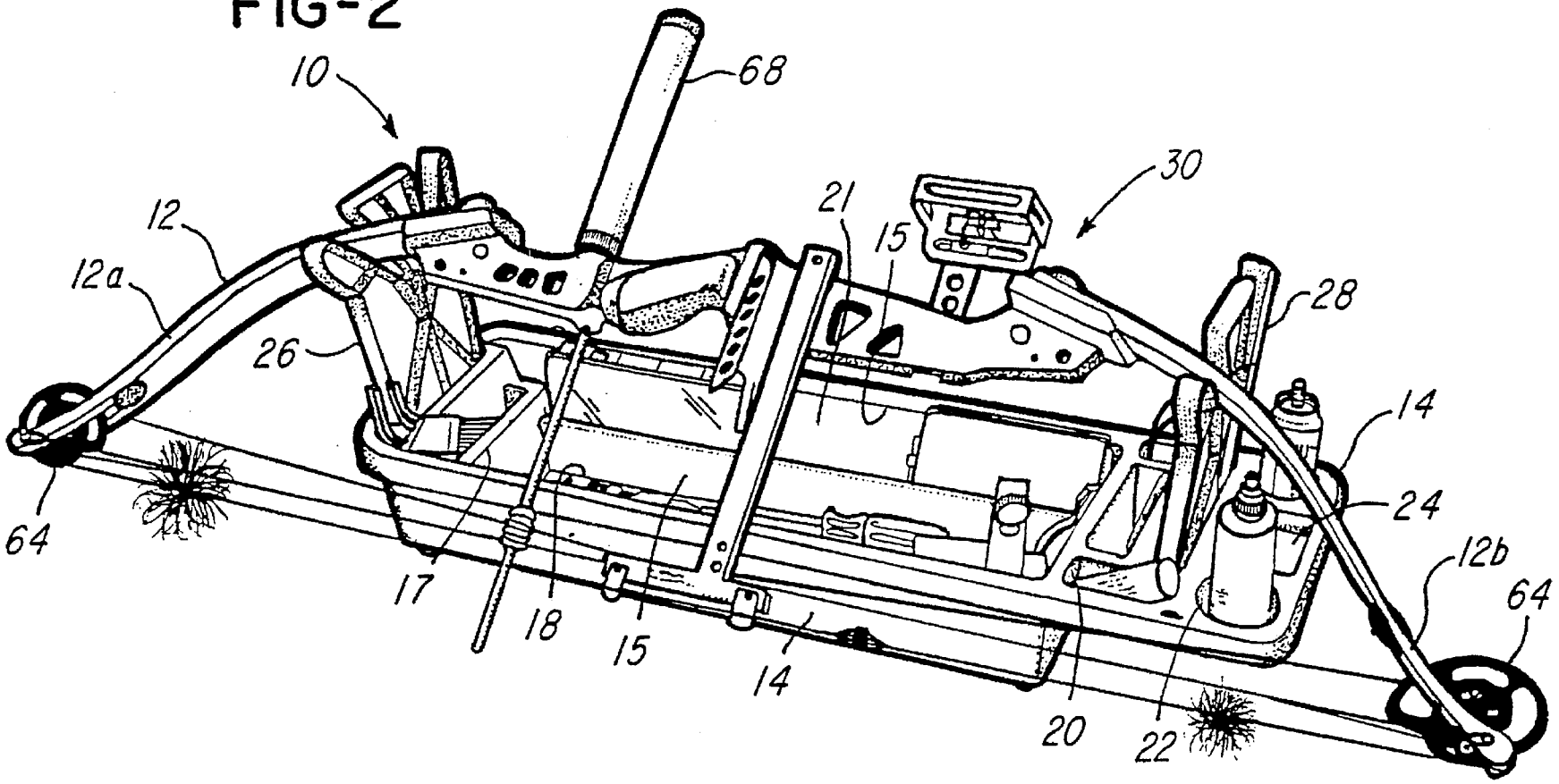
FIG. 2 is another view of the bow maintenance center shown in FIG. 1 showing the bow supporting in a "sight-up" 45° angle position.

It should be appreciated that the bow maintenance center is portable and of lightweight construction. The aperture 16*a* has dimensions of approximately 2½"×4½"×⅞" (at the widest point of the aperture 16*a*). Notice that aperture 16*c* comprises dimensions of about 3¾"×4¾"×1" (at the widest point opening of the aperture 16*c*). In the embodiment being described, the base is approximately 4½"×9¼" by 28¾". As best illustrated in FIGS. 2 and 3, base 14 comprises a wall 15 integrally formed as part thereof and extending between walls 17 and 19 to define an elongated aperture 21 which is suitable for supporting various items, such as a tool case 23 (FIG. 1).

Figure 4:
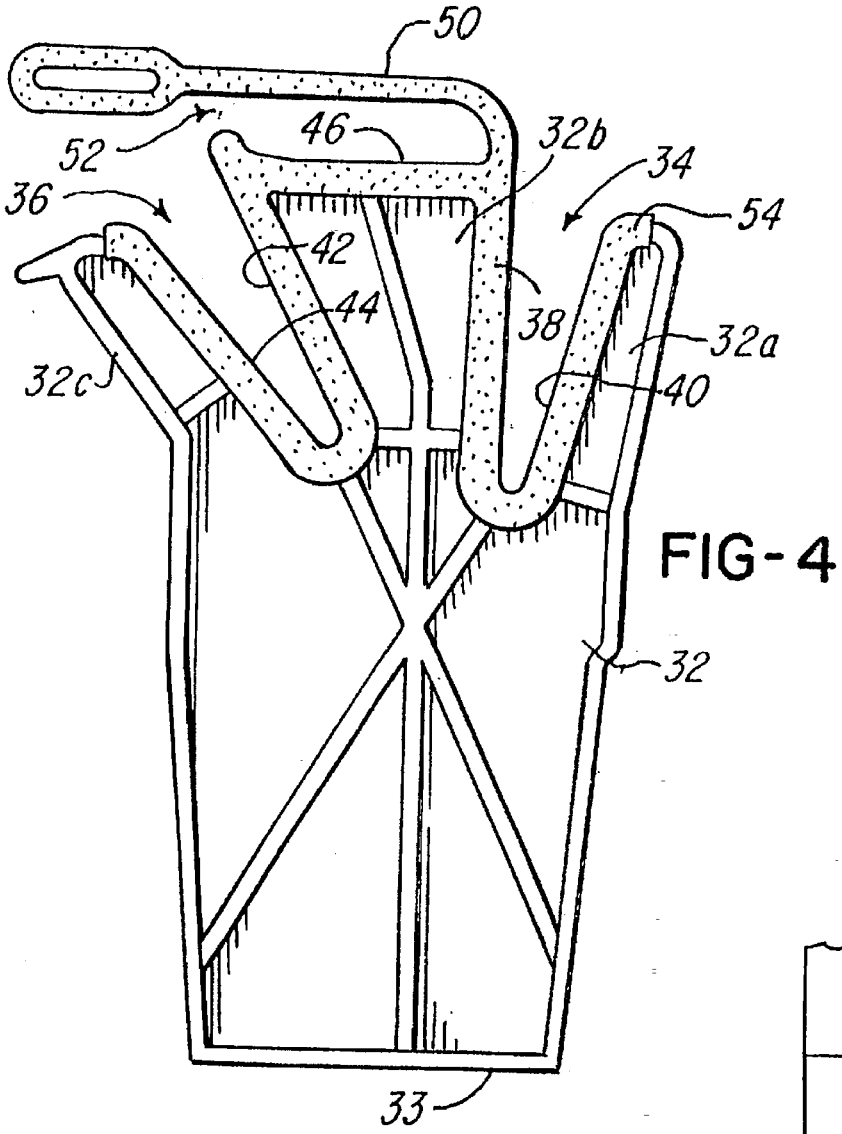
FIG. 4 is a side view of a fork member comprising a generally L-shaped latch which may be used as an adjustable support on the base.

The bow maintenance center also comprises a plurality of adjustable supports 26 and 28 for adjustably supporting the bow 12 at a maintenance position 30. As best illustrated in FIG. 4, each of the adjustable supports 26 and 28 may comprise a fork member 32 having a plurality of receiving apertures 34 and 36 for receiving bow stave 13 and for supporting the bow 12 in one of a plurality of predetermined maintenance positions. As described later herein, component 18 also provides a storage area for storing the adjustable supports 26 and 28.

As best illustrated in FIG. 4, the adjustable supports 26 and 28 may each comprises a fork member 32 comprising a first leg portion 32*a*, a second leg portion 32*b*, and a third leg portion 32*c* which cooperate to define the plurality of receiving apertures 34 and 36. In the embodiment being described, the fork member 32 comprises a height (as viewed in FIG. 4), having dimensions of about 4½"×10"×1".

As illustrated in FIG. 4, the fork member 32 may have a rubber or foam material secured thereto so as not to scratch or damage the bow 12 when it is mounted on one of the receiving areas 34, 36 and 52.

Figure 5:
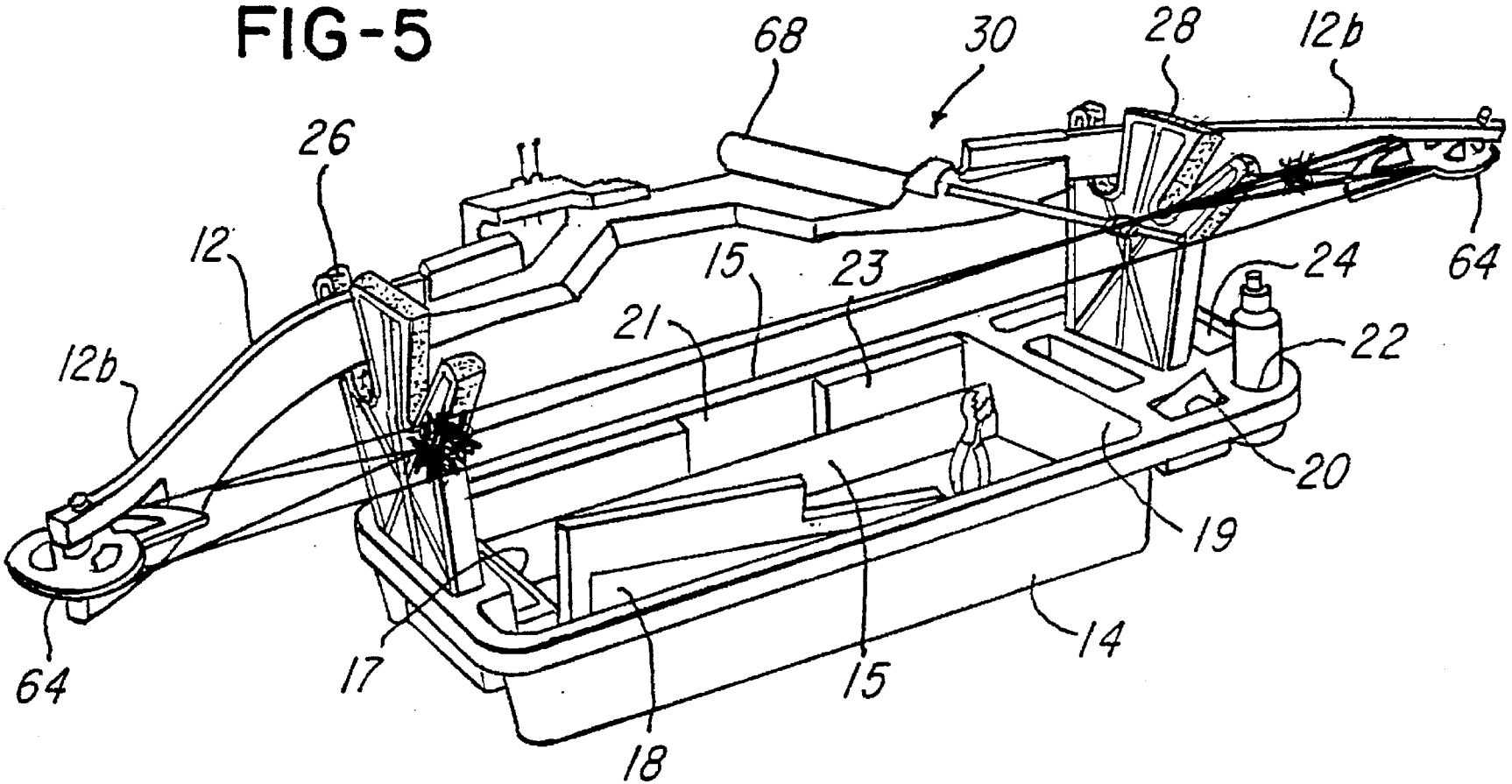
FIG. 5 is isometric view of the bow maintenance center showing the bow supported in a general horizontal position.
Figure 6:
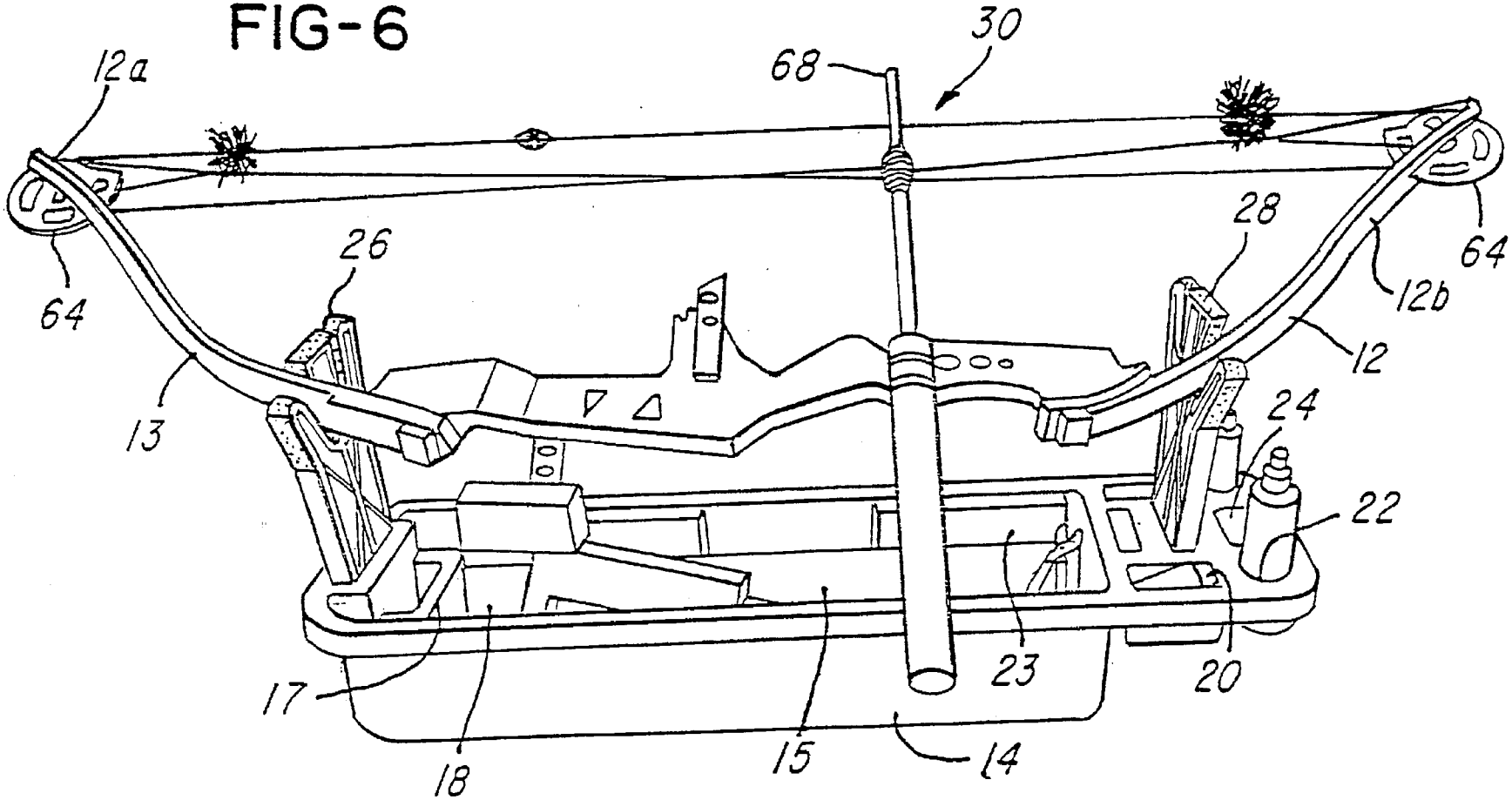
FIG. 6 is a plan view of the bow maintenance center showing the bow positioned in a 45° degree angle "sight-down" position.

Notice that a wall 38 of second leg portion 32*b* and wall 40 of first leg portion 32*a* define the U-shaped receiving aperture 34. Likewise, wall 42 of second leg portion 32*b* and wall 44 of third leg portion 32*c* define the U-shaped receiving aperture 36. Notice also that the various walls 38–44 lie in different planes or angles relative to a bottom surface 33 of fork member 32. Notice that the second leg portion 32*b* also comprises a support surface 46 which is substantially parallel to bottom surface 33. These angles facilitate supporting the bow 12 in various angular positions, such as the position illustrated in FIG. 1; the horizontal position in FIG. 5 and the 45 degree position shown in FIGS. 2 and 6.

Advantageously, the apertures 34, 36 and 52 facilitate hands free support of the bow 12 so that, for example, the bow 12 is supported above the work surface (not shown) on which the base 14 is supported.

Figure 8:
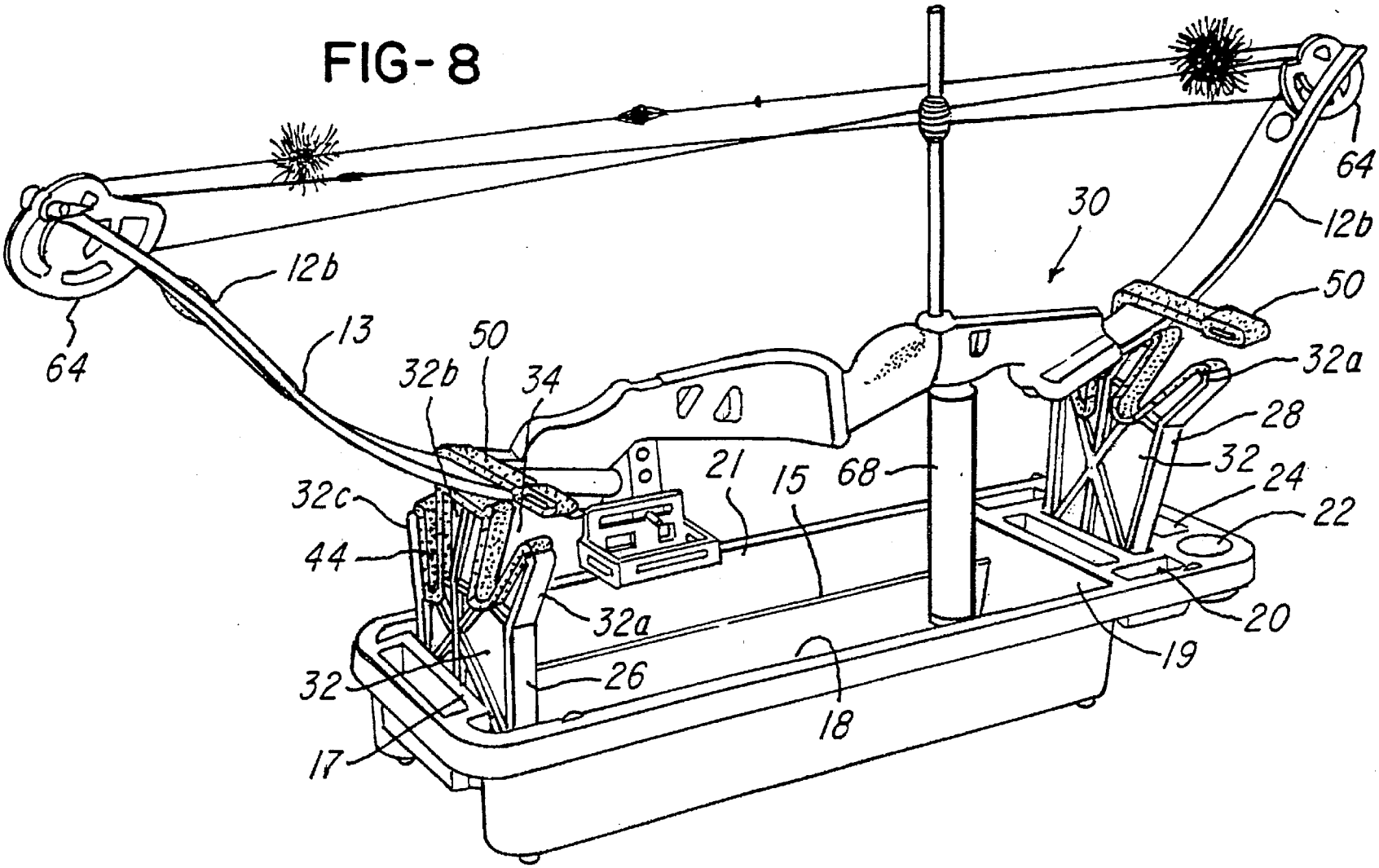
FIG. 8 is another illustration of bow maintenance center showing a plurality of forks of the type shown in FIG. 4 mounted thereto with one fork being position being higher than another and showing generally L-shaped latches locking the bow in the cable-up position.

Notice that fork member 32 may comprise a generally L-shaped strap or latch 50 (FIG. 4) which defines an elongated aperture 52 for facilitating locking and/or supporting bow 12 in the position shown in FIGS. 1 and 8.

It should be appreciated that although the fork member 32 is shown as having the predefined apertures 34 and 36 having surfaces which facilitate supporting the bow in various angles, the fork member 32 could be configured with more or fewer apertures defining the same or different angles as may be desired. Also, more or fewer adjustable supports may be used as desired.

Figure 7:
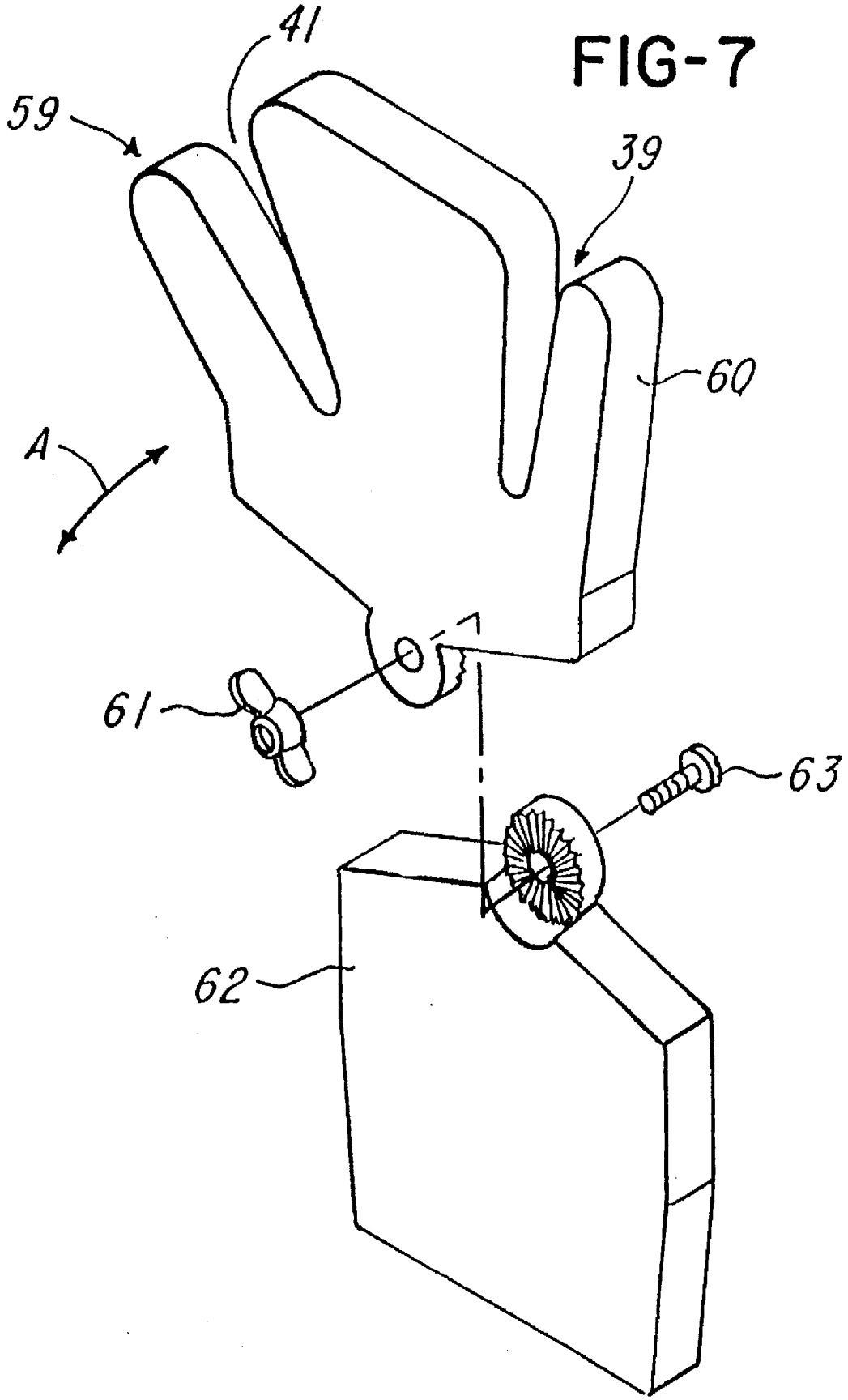
FIG. 7 is an illustration of another embodiment of a fork member having a ratcheting connector for permitting a top portion of the fork member to be adjustably secure to a bottom portion of the fork member such that the top fork may be pivoted in order to change an angle of the bow when it is placed in one of a plurality of receiving areas defined by the top fork.

FIG. 7 shows another embodiment where adjustable support 26 or 28 comprises a fork top member 60 of a fork 59 which is adjustably mounted on a fork base 62 by suitable securing fastener or means, such as the screw 63 and wing nut 64. With this configuration, the angle of the apertures 39 and 41 in fork top member 60 may be pivotally adjusted (in the direction of double arrow A in FIG. 7) by changing the position of the fork top member 60 relative to the fork base 62. A method for servicing the bow 12 using the maintenance center 10 will now be described.

When it is desired to service or provide maintenance to the bow 12, the adjustable support 26 is inserted into either apertures 16*a* or 16*b* (FIG. 3). Likewise, adjustable support 28 is inserted into either 16*c* or 16*d* as desired. As illustrated in FIG. 3, notice that the depths of apertures 16*a* and 16*d* are substantially the same relative to a top 19 of base 14, while the depths or the apertures of 16*b* and 16*c* are substantially the same relative to the top 19 of base 14. Notice also that the depths of apertures 16*b* and 16*c* are deeper than the depths of apertures 16*a* and 16*d*, as illustrated in FIG. 3. This facilitates selectively positioning the supports 26 and 28 at different heights relative to each other such that, for example, an end 12*a* of bow 12 (FIG. 8) is supported higher or lower than an end 12*b* of bow 12. For example, if adjustable support 28 is positioned in aperture 16*d*, while adjustable support 26 is positioned in aperture 16*b*, then a bow end 12*a* may be supported lower than end 12*b*, as illustrated in FIG. 8.

The adjustable supports 26 and 28 are situated on the base 14 such that their respective receiving apertures 34 and 36, for example, become generally aligned. Once the adjustable supports 26 and 28 are selectively positioned in apertures 16*a*–16*d*, then the bow 12 may be situated thereby causing the bow 12 to be positioned in one of the plurality of different angular positions shown. Thereafter, the bow 12 may be serviced and maintained.

If one or both of the adjustable supports 26 and 28 include the fork 59 shown in the embodiment of FIG. 7, then the base top member 60 is adjusted using the screw 63 and wing nut 64 relative to the fork base 62 either while the adjustable fork 59 is separate from or situated on the base 14*aaaa*.

After the bow 12 is supported in one of the illustrated plurality of maintenance positions, a cleaning solution which is situated, for example, in aperture 22 or 24 of base 14, may be used to clean the bow 12. Also, one or more of the various tools 65 (FIG. 1) may be used to adjust the bow 12. For example, one or more of pulleys 64 on the bow 12 (FIG. 1) may be adjusted in order to change and/or tighten on or more on cables 66 on the bow 12.

Advantageously, the method and apparatus of this invention facilitate supporting the bow 12 in one of a plurality of maintenance positions, even when a bow press 68 is situated on bow 12. The bow maintenance center may also be used to secure and store the bow 12 when it is not in use. In addition, the base 14 and adjustable supports 26 and 28 are separate pieces molded from plastic, thereby providing a light weight, and simple construction.

Notice that the method and apparatus of this invention facilitates supporting the bow 12 in a maintenance position so that an archer's hands are free to maintain the bow by, for example, tightening nuts and making adjustments, such as to a site mechanism 67 on the bow 12.

While the method herein described, and the form of apparatus for carrying this method into effect, constitute preferred embodiments of this invention, it is to be understood that the invention is not limited to this precise method and form of apparatus, and that changes may be made in either without departing from the scope of the invention, which is defined in the appended claims.

What is claimed is:

1. A bow maintenance center for maintaining a bow comprising:

a maintenance base for receiving at least one bow maintenance item; and an adjustable support comprising a general line of axis and situated on said maintenance base for adjustably supporting said bow in a plurality of maintenance positions about said general line of axis; said adjustable support comprising a support member defining a plurality of slots for receiving said bow in said plurality of maintenance positions.

2. The bow maintenance center as recited in claim 1 wherein said at least one fork comprises a first leg portion, a second leg portion and a third leg portion which cooperate to define said plurality of slots.

3. The bow maintenance center as recited in claim 2 wherein said first leg portion, said second leg portion and said third leg portion define a pair of generally U-shaped receiving apertures for supporting the bow at different angles.

4. The bow maintenance center as recited in claim 1 wherein said maintenance base comprises at least one aperture for receiving said adjustable support.

5. The bow maintenance center as recited in claim 1 wherein said plurality of angular positions range from 0° to 180°.

6. A bow maintenance center for maintaining a bow comprising:

a maintenance base for receiving at least one bow maintenance item;

an adjustable support situated on said maintenance base for adjustably supporting said bow in a plurality of maintenance positions;

wherein said maintenance base comprises a plurality of apertures; and said adjustable support further comprising a plurality of forks for situating in said plurality of apertures.

7. The bow maintenance center as recited in claim 6 wherein said plurality of forks comprise a plurality of bow receiving apertures, said plurality of apertures on said maintenance base being situated such that said plurality of forks become aligned when said plurality of forks are received in said plurality of fork apertures.

8. The bow maintenance center as recited in claim 7 wherein said plurality of forks comprise a first fork having a first bow receiving area and a second bow receiving area and a second fork having a third bow receiving area and a fourth bow receiving area, said first and second bow receiving areas becoming generally aligned with said third and fourth bow receiving areas when said plurality of forks are received in said plurality of fork apertures.

9. A method for servicing a bow comprising the steps of:

adjustably positioning at least one adjustable support on a base which is positioned on a surface, said at least one adjustable support defining a plurality of slots;

situating said bow on said at least one adjustable support and in at least one of said plurality of slots, thereby causing said bow to be positioned in one of a plurality of different angular positions;

at least one of said plurality of different angular positions being a position in which said bow lies in a plane which is not perpendicular to said surface; and servicing said bow.

10. The method as recited in claim 9 wherein said method further comprises the step of:

providing a plurality of bow fork supports;

mounting said plurality of bow fork supports onto said base.

11. The method as recited in claim 10 wherein each of said bow fork supports comprise a plurality of fingers, said method further comprising the step of:

inserting said bow between at least two of said plurality of fingers.

12. The method as recited in claim 9 wherein said method further comprises the step of:

situating a cleaning solution on said base;

cleaning said bow with said cleaning solution.

13. A bow maintenance system comprising:

a maintenance base lying in a first plane; and a bow holder coupled to said maintenance base for receiving a bow and for supporting said bow in a maintenance position above said maintenance base; said maintenance position having a plurality of angular positions such that said bow lies in a plane which is angled relative to said first plane, said bow holder defining a plurality of slots for receiving said bow such that it is supported in said plurality of angular positions.

14. The bow maintenance system as recited in claim 13 wherein said plurality of angular positions range from about 0 to about 180 degrees.

15. A bow maintenance system comprising:

a maintenance base; and a bow holder coupled to said maintenance base for receiving a bow and for supporting said bow in a maintenance position above said maintenance base;

wherein said bow holder comprises a bow strap coupled to said bow holder for supporting said bow in a generally upright position relative to said maintenance base.

16. A bow device for holding a bow comprising;

a bow support for positioning on a surface;

means situated on the bow support for supporting at least one end of the bow in one of a plurality of angular positions during which said bow lies in a plane which is not perpendicular to said surface, said means defining a plurality of slots for receiving the bow such that it is supported in one of said plurality of angular positions.

17. The bow device as recited in claim 16 wherein said bow comprises a bow press secured thereto.

18. The bow device as recited in claim 16 wherein said means comprises at least one support for supporting the bow at both ends thereof.

* * * * *

UNITED STATES PATENT AND TRADEMARK OFFICE

CERTIFICATE OF CORRECTION

PATENT NO. : 5,640,944

DATED : June 24, 1997

INVENTOR(S) : Minneman

It is certified that error appears in the above-indentified patent and that said Letters Patent is hereby corrected as shown below:

On the title page, item [56], Other Publications, lines 5-6, "Case-G-ard', by MTM Case-Guard." should be --Case-Gard", by MTM Case-Gard.--.

On the title page, item [57], line 10, "comprises" should be --include--.

Column 2, line 12, "isometric" should be --an isometric--.

Column 2, line 13, "general" should be --generally--.

Column 2, line 24, "of bow" should be --of the bow--.

Column 3, line 53, "nut 64" should read --nut 61--

Column 4, line 22, "nut 64" should be --nut 61--.

Column 4, line 23, "14*aaaa*." should be --14*a*.--.

Column 4, line 31, "on or more on cables" should be --one or more of cables--.

Claim 2, column 4, line 65, delete "wherein said at least one fork comprises" and insert --wherein said adjustable support comprises at least one fork, said at least one fork comprising-- therefor.

Claim 5, column 5, line 10, delete "wherein said plurality of angular positions" and insert --wherein the angles of said plurality of maintenance positions-- therefor.

UNITED STATES PATENT AND TRADEMARK OFFICE

CERTIFICATE OF CORRECTION

PATENT NO. : 5,640,944

DATED : June 24, 1997

INVENTOR(S) : Minneman

It is certified that error appears in the above-indentified patent and that said Letters Patent is hereby corrected as shown below:

Claim 16, column 6, line 37, "on the bow" should be --on said bow--.

Claim 16, column 6, line 38, delete "of the bow" and insert --of said bow-- therefor.

Claim 16, column 6, line 41, "receiving the bow" should be --receiving said bow--.

Claim 18, column 6, line 47, "supporting the bow" should be --supporting said bow.

Signed and Sealed this

Twenty-first Day of July, 1998

Bruce Lehman

*Attest:*

BRUCE LEHMAN

*Attesting Officer*

*Commissioner of Patents and Trademarks*